United States Patent [19]

Echols

[11] Patent Number: 4,704,924

[45] Date of Patent: Nov. 10, 1987

[54] SAFETY STOPPER ENGAGER

[76] Inventor: Ronald Echols, 3188 Aris Dr., Warren, Ohio 44483

[21] Appl. No.: 843,243

[22] Filed: Mar. 24, 1986

[51] Int. Cl.[4] ..... B67B 7/02

[52] U.S. Cl. ..... 81/3.4; 81/3.36; 7/151

[58] Field of Search ..... 81/3.4, 3.29, 3.36, 81/3.08, 3.05, 3.09; D8/42; 7/151, 154, 155, 169, 170; 215/296

[56] References Cited

U.S. PATENT DOCUMENTS

| | | | |
|---|---|---|---|
| 276,064 | 4/1883 | Morse | 81/3.4 |
| 1,615,196 | 1/1927 | Lilja | 81/3.4 |
| 1,952,660 | 3/1934 | Drydon | 81/3.4 |
| 3,812,741 | 5/1974 | Heine | 81/3.4 |
| 4,522,089 | 6/1985 | Alvi | 7/151 X |

FOREIGN PATENT DOCUMENTS

| | | | |
|---|---|---|---|
| 14270 | of 1895 | United Kingdom | 81/3.29 |

*Primary Examiner*—Frederick R. Schmidt
*Assistant Examiner*—Debra S. Meislin
*Attorney, Agent, or Firm*—Harpman & Harpman

[57] ABSTRACT

A safety stopper engager for use with test tubes to grip and retain a test tube stopper and prevent contamination of the user as the stopper is removed. The safety stopper engager has a resilient outer body with a contoured, concave recess portion and a safety absorbent ring. The safety stopper engager retains the stopper and absorbs test tube content's residue avoiding contamination of the test tube and the user.

5 Claims, 3 Drawing Figures

SAFETY STOPPER ENGAGER

BACKGROUND OF THE INVENTION

1. Technical Field

This invention relates to closure removal devices used to engage and remove different types of closures.

2. Description of the Prior Art

Prior art devices of this type have relied on a variety of different design configurations that have been developed. See for example U.S. Pat. Nos. 3,812,741, 1,615,196 and 1,952,660.

In U.S. Pat. No. 3,812,741 a bottle cap remover is disclosed that has an annular enclosure with a plurality of spaced ribs and grooves on its inner vertical surface. Two forms of the invention are shown with one having a single row of grooves and ribs and a slightly tapered inner lip and a second form with a double row of ribs and grooves adjacent the opening and spaced inwardly therefrom.

In U.S. Pat. No. 1,615,196, a jar opener is disclosed that has a plurality of recesses and ribs within an enclosure. The opener is pushed down over the jar to be opened with the inner surface engaging the jar lid for removal.

In U.S. Pat. No. 1,952,660, a jar opening device is disclosed that his quite similar to U.S. Pat. No. 1,615,196 in that a resilient body is shown having a plurality of spaced internal ribs and recesses. The ribs and recesses provide a gripping action on the lid to be removed.

SUMMARY OF THE INVENTION

A safety stopper engager that will retain a test tube stopper for easy removal from the test tube. The safety stopper engager has a resilient configuration with an absorbent insert and a rib interior surface that grips the test tube stopper and retains the same while preventing contamination of the outer surface of the test tube and the user as the stopper is removed.

DESCRIPTION OF THE PREFERRED EMBODIMENT

Figure 1:
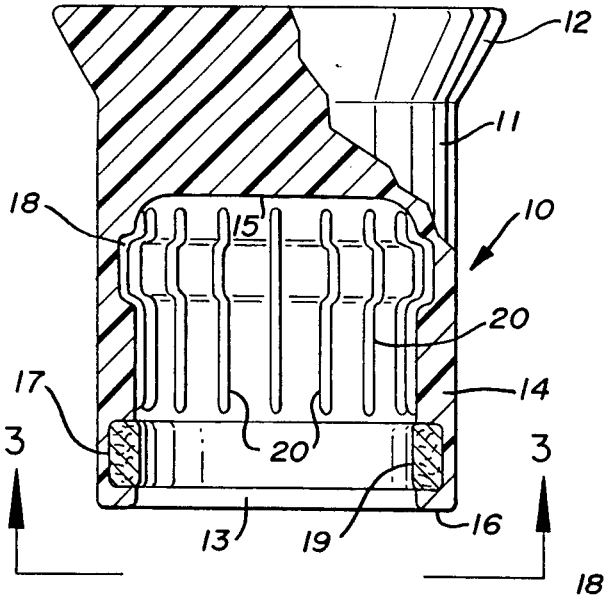
FIG. 1 is a front elevation of the safety stopper engager with a portion but away in cross section.

A safety stopper engager 10 can be seen in FIG. 1 of the drawings having a generally cylindrical main body member 11 within an enlarged end portion 12. The outer surface of the main body member 11 is textured to provide an adequate grip for the user. The main body member 11 is made of a resilient material such as rubber or a synthetic resin as will be well understood by those skilled in the art. A cavity 13 is formed in the other end of said cylindrical body member in oppositely disposed relation to said enlarged end portion 12. The cavity 13 defines an annular wall 14 with a generally featureless interior end portion 15 and a lower edge portion 16. The annular wall 14 has two vertically spaced annular recessed bands 17 and 18 with the band 17 adjacent the lower edge portion 16.

Figure 2:
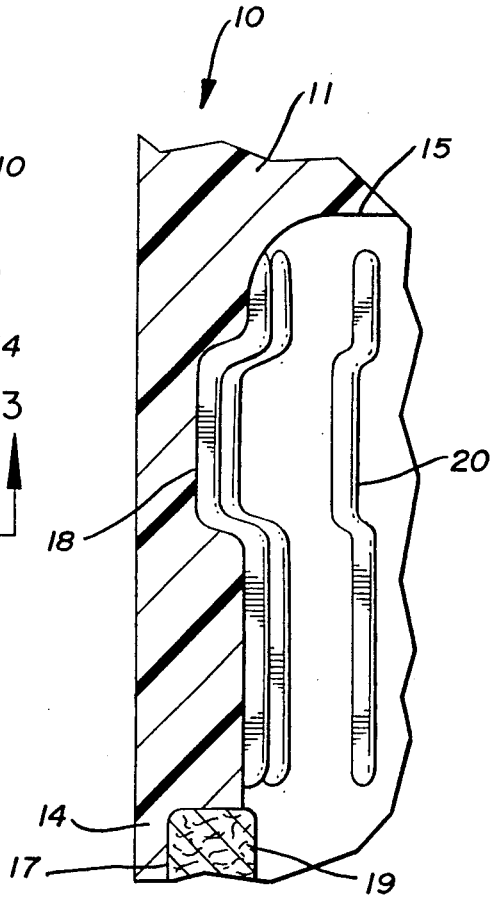
FIG. 2 is an enlarged cross sectional view of a portion of the safety stopper engager in FIG. 1 of the drawings.
Figure 3:
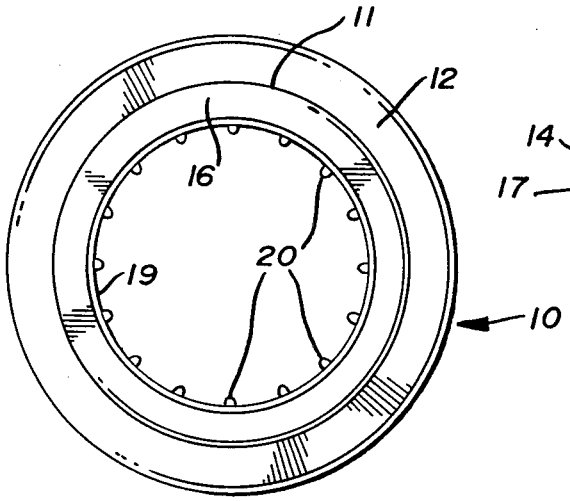
FIG. 3 is a bottom plan view on lines 3—3 of FIG. 1.

An annular ring of absorbent material 19 has a registering configuration to said recessed band 17 and is engaged within so that only a small portion of the resilient material extends outwardly from the vertical plane of the interior of said wall 14. The recess 18 is characterized by a plurality of annularly spaced vertically aligned parallel ribs 20 that extend transversely over the recess 18. Each of the ribs extend from a point on the annular wall 14 adjacent the ring of absorbent material 19 along the annular wall 14 into, across and out of the recess 18 following the contour of the surface. The ribs 20 end at a point adjacent the end portion 15 as best seen in FIGS. 1 and 2 of the drawings. .

It will be evident from the above description that the safety stopper engager is pushed downwardly over a test tube with a stopper (not shown) and that the annular wall 14 will deflect slightly due to its resilient material and that the multiple ribs 20 will engage on the outer surface of the test tube stopper and securely hold the same within.

As the test tube stopper is removed within the safety stopper engager, the lower portion of the safety stopper engager with its annular ring of absorbent material 19 will move vertically over the outer surface of said test tube, not shown, wiping the same and removing any residue from the removed stopper on the outer portion of the test tube greatly reducing the chance of accidental contamination of the user. The safety stopper engager with its annular ring of absorbent material 19 will prevent contact of test tube contents residue carried with the stopper as it is removed within the safety stopper remover by the user due to its absorbent construction characteristics.

The safety stopper engager will initially hold and retain the stopper for reinsertion into the test tube for storage. The safety stopper engager is designed to be used with common test tube stopper configurations and will accommodate slight variations due to the resilient nature of its material.

It will thus be seen that a new and useful safety stopper engager has been illustrated and described and that various changes and modifications may be made therein without departing from the spirit of the invention and having thus described my invention what I claim is:

1. A safety stopper engager for removing stoppers from test tubes comprises a resilient cylindrical body member, a cavity in one end of said cylindrical body member, a plurality of spaced recessed annular bands within said cavity, absorbent means in one of said bands extending outwardly therefrom, the other of said bands for engaging an increased diameter of said stopper about its upper portion, means for stabilizing said stopper remover in an independent fashion away from said test tube and means for retaining said stopper within said safety stopper engager.

2. The safety stopper engager of claim 1 wherein said cavity defines a resilient annular wall of varying cross sectional thickness.

3. The safety stopper engager of claim 1 wherein said absorbent means in one of said bands is a fabric felt.

4. The safety stopper engager of claim 1 wherein said means for retaining said stopper within said safety stopper engager comprises spaced vertical ribs extending transversely through one of said recessed annular bands.

5. The safety stopper engager of claim 1 wherein means for stabilizing said safety stopper engager comprises an enlarged end of said cylindrical body member opposite said cavity.

* * * * *